US010797432B2

(12) United States Patent
Takagi et al.

(10) Patent No.: US 10,797,432 B2
(45) Date of Patent: Oct. 6, 2020

(54) CONNECTOR INCLUDING A HOUSING INTO WHICH A CABLE IS INSERTED AND A REAR HOUSING TO GUIDE THE CABLE AND MAINTAIN SHAPES OF PORTIONS OF THE CABLE

(71) Applicant: Yazaki Corporation, Tokyo (JP)

(72) Inventors: Akiyoshi Takagi, Shizuoka (JP); Hikaru Oi, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/436,120

(22) Filed: Jun. 10, 2019

(65) Prior Publication Data

US 2019/0386424 A1 Dec. 19, 2019

(30) Foreign Application Priority Data

Jun. 15, 2018 (JP) ..... 2018-114271

(51) Int. Cl.

| | |
|---|---|
| ***H01R 13/52*** | (2006.01) |
| ***H01R 13/422*** | (2006.01) |
| ***H01R 13/516*** | (2006.01) |
| ***H01R 13/56*** | (2006.01) |
| ***H01R 13/58*** | (2006.01) |

(52) U.S. Cl.

CPC ..... *H01R 13/5205* (2013.01); *H01R 13/422* (2013.01); *H01R 13/516* (2013.01); *H01R 13/56* (2013.01); *H01R 13/58* (2013.01)

(58) Field of Classification Search

CPC .. H01R 13/5205; H01R 13/516; H01R 13/56; H01R 13/58; H01R 13/422

USPC ..... 439/587

See application file for complete search history.

(56) References Cited

U.S. PATENT DOCUMENTS

| | | | | |
|---|---|---|---|---|
| 4,684,197 | A * | 8/1987 | Reichardt | H01R 12/675 439/404 |
| 5,873,737 | A * | 2/1999 | Hashizawa | H01R 13/6205 439/39 |
| 5,931,699 | A * | 8/1999 | Saito | H01R 13/5208 439/275 |
| 6,302,734 | B1 * | 10/2001 | Ichio | H01R 13/5208 439/274 |
| 6,676,447 | B1 * | 1/2004 | Knox | H01R 13/523 439/274 |
| 6,821,160 | B2 * | 11/2004 | Fink | H01R 13/512 439/595 |
| 6,962,504 | B2 * | 11/2005 | Fukui | H01R 13/562 439/466 |
| 6,971,905 | B2 * | 12/2005 | Makita | H01R 13/5205 439/447 |

(Continued)

FOREIGN PATENT DOCUMENTS

| | | |
|---|---|---|
| EP | 2 475 049 A1 | 7/2012 |
| JP | 10-112347 A | 4/1998 |

(Continued)

*Primary Examiner* — Harshad C Patel
(74) *Attorney, Agent, or Firm* — Sughrue Mion, PLLC

(57) ABSTRACT

A connector includes: a housing into which a cable is inserted; and a rear housing mounted on the housing and guiding the cable extending from the housing to maintain shapes of portions and of the cable, the portions and being in the vicinity of the housing.

2 Claims, 8 Drawing Sheets

(56) References Cited

U.S. PATENT DOCUMENTS

| | | | | |
|---|---|---|---|---|
| 8,529,273 | B2 * | 9/2013 | Maegawa | H01R 4/20 439/34 |
| 8,939,788 | B2 * | 1/2015 | Eminovic | H01R 13/516 439/465 |
| 9,496,637 | B2 * | 11/2016 | Ichio | H01R 13/4367 |
| 9,893,454 | B2 * | 2/2018 | Tomita | H01R 13/504 |
| 2002/0177351 | A1 | 11/2002 | Kihira et al. | |
| 2008/0032544 | A1 * | 2/2008 | Tsuji | H01R 13/506 439/470 |
| 2008/0280467 | A1 * | 11/2008 | Tsuji | H01R 13/4223 439/135 |
| 2012/0021632 | A1 * | 1/2012 | Matsumoto | H01R 13/506 439/271 |
| 2015/0333434 | A1 * | 11/2015 | Duquesne | H01R 13/5205 439/587 |
| 2016/0043492 | A1 * | 2/2016 | Nakai | H01R 13/4226 439/752 |
| 2017/0229808 | A1 * | 8/2017 | Mukuno | H01R 13/58 |

FOREIGN PATENT DOCUMENTS

| | | | | |
|---|---|---|---|---|
| JP | 2000-268908 | * | 9/2000 | |
| JP | 2002-352901 | A | 12/2002 | |
| JP | 2013-110025 | A | 6/2013 | |
| JP | 2015-99719 | A | 5/2015 | |
| WO | WO-2018168394 | A1 * | 9/2018 | H01R 13/56 |

* cited by examiner

CONNECTOR INCLUDING A HOUSING INTO WHICH A CABLE IS INSERTED AND A REAR HOUSING TO GUIDE THE CABLE AND MAINTAIN SHAPES OF PORTIONS OF THE CABLE

CROSS REFERENCE TO RELATED APPLICATIONS

The present application claims priority to Japanese Patent Application No. 2018-114271 filed on Jun. 15, 2018, the entire contents of which are incorporated by reference herein.

BACKGROUND

Technical Field

The present invention relates to a connector.

Related Art

Conventionally, as illustrated in FIG. 9, a connector 301 including a connector cover 307 attached to a back end of a connector housing (housing) 303 and restraining an introduction direction of a cable 305 has been known.

Here, a patent literature related to the technology according to the related art includes JP 2013-110025 A.

SUMMARY

In the conventional connector 301, a large gap 309 is present between the cable 305 extending from the housing 303 and the connector cover 307 mounted on the housing 303, and thus a bend radius of the cable 305 extending from the housing 303 while being bent is changed in some cases. An excessive bending stress is applied to the cable 305 due to the change in the bend radius, which is problematic.

The present invention has been made to solve the problem described above, and an object of the present invention is to provide a connector in which a bend radius of a bent portion of a cable extending from a housing is small, the bent portion being in the vicinity of the housing, thereby making it possible to prevent an excessive bending stress from being applied to the cable.

According to an aspect of the present invention, a connector includes: a housing into which a cable is inserted; and a rear housing mounted on the housing, configured to guide the cable extending from the housing to maintain shapes of portions of the cable, the portions being in the vicinity of the housing.

According to the present invention, it is possible to provide a connector in which a bend radius of a bent portion of a cable extending from a housing is small, the bent portion being in the vicinity of the housing, thereby making it possible to prevent an excessive bending stress from being applied to the cable.

BRIEF DESCRIPTION CF DRAWINGS

DETAILED DESCRIPTION

Figure 1:
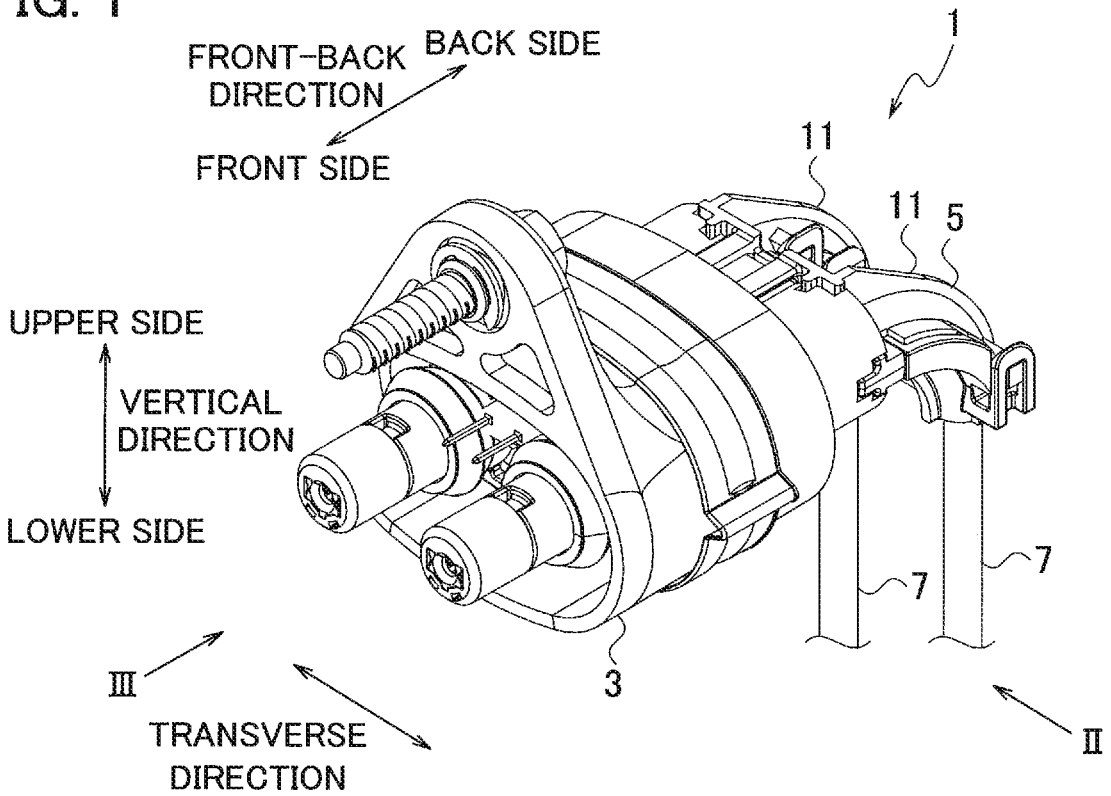
FIG. 1 is a perspective view illustrating a connector according to an embodiment of the present invention.
Figure 2:
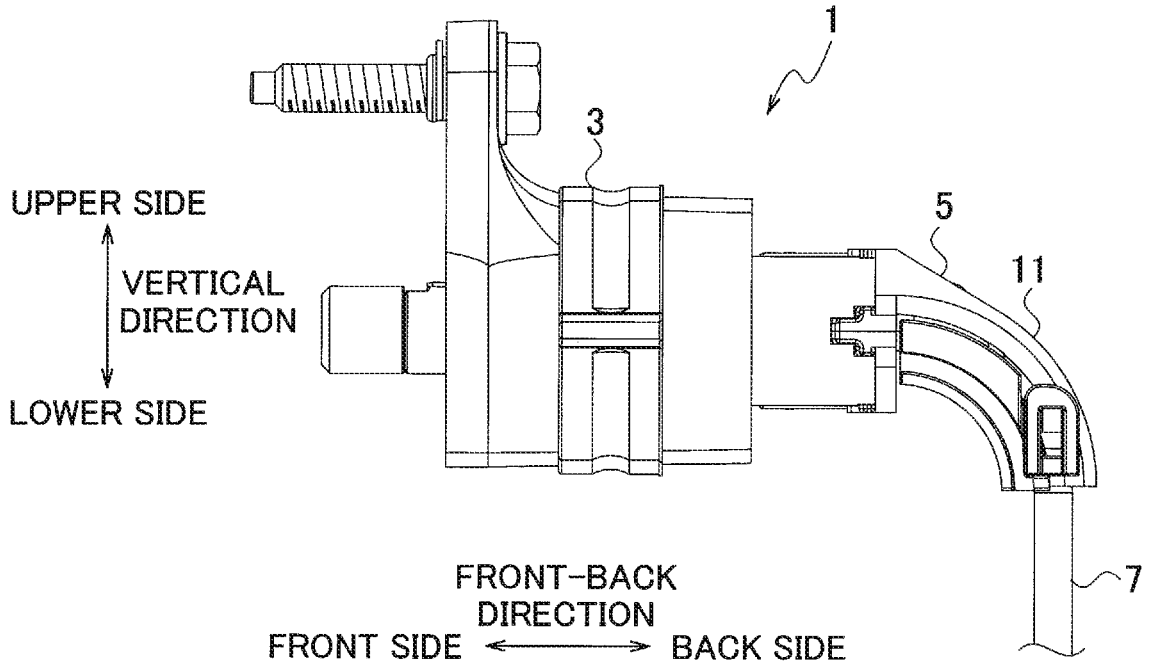
FIG. 2 is a view when viewed in an arrow direction II of FIG. 1.
Figure 3:
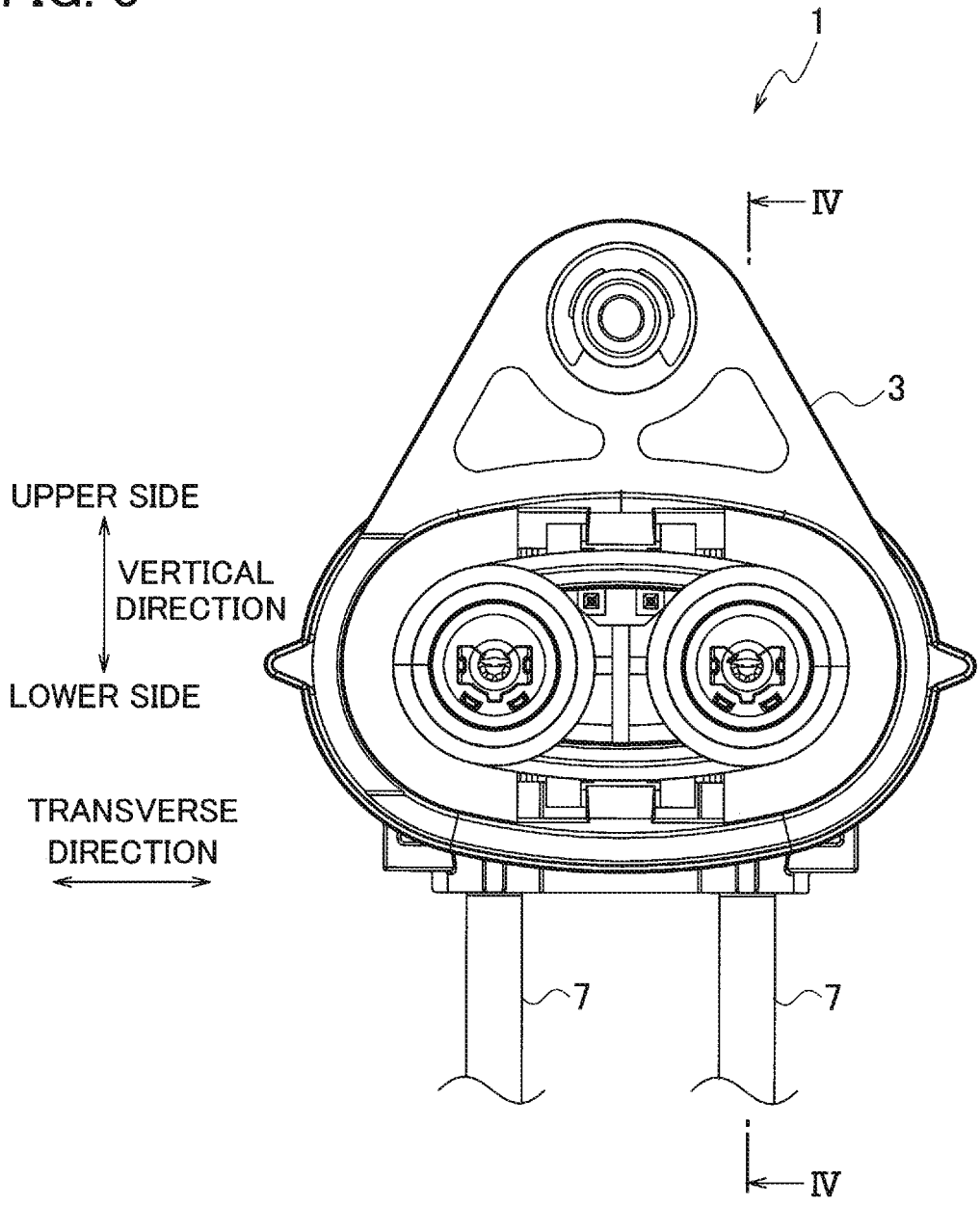
FIG. 3 is a view when viewed in an arrow direction III of FIG. 1.

A connector 1 according to an embodiment of the present invention is used in, for example, a vehicle, and includes a housing 3 and a rear housing (rear holder) 5 as illustrated in FIGS. 1 to 4.

Here, for convenience of explanation, a predetermined direction in a space is defined as a front-back direction, a predetermined direction orthogonal to the front-back direction is defined as a transverse direction, and a direction orthogonal to the front-back direction and the transverse direction is defined as a vertical direction.

A cable 7 (one end portion of the cable 7 in a longitudinal direction) is inserted into the housing 3. The cable 7 has flexibility, and the cable 7 of which one end portion is fixed in (inserted into) the housing 3 extends from the housing 3 to a back side or a lower side.

The rear housing 5 is mounted on the housing 3 to guide the cable 7. That is, the rear housing 5 is integrally mounted on the housing 3 to maintain shapes of portions (portions of the cable 7 in the vicinity of the housing) 15 and 17 of the cable 7 in the vicinity of the housing 3, for example, bent portions.

In more detail, the rear housing 5 is integrally mounted on the housing 3 in order to maintain desired shapes of the portions 15 and 17 of the cable 7 in the vicinity of the housing (more specifically, in order to maintain a desired bend radius of the cable).

A sealing material 9 formed in a ring shape (for example, a cylindrical shape) is provided in the connector 1. The cable 7 is inserted into the sealing material 9. The sealing material 9 into which the cable 7 is inserted is mounted in the housing 3 together with the cable 7 to seal between the housing 3 and the cable 7.

In addition, one end portion (front end portion) of the rear housing 5 is inserted into the housing 3 to thereby prevent the sealing material 9 from being detached from the housing 3.

The shapes of the portions 15 and 17 (the portions in the vicinity of the housing 3) of the cable 7 are maintained by the rear housing 5 in order to prevent sealability (sealing performance) of the sealing material 9 from deteriorating as a gap is formed between the sealing material 9 and the housing 3, or a gap is formed between the sealing material 9 and the cable 7 due to deformation of the sealing material 9 caused by deformation of the portion of the cable 7 penetrating through the sealing material 9 (for example, deformation in which a bend radius of the cable 7 becomes excessively small or the like).

The guiding of the cable 7 by the rear housing 5 is made as the cable 7 is inserted into a cylindrical portion (cylindrical portion of which an inner diameter is equal to or slightly larger than an outer diameter of the cable) 11 of the rear housing 5.

As illustrated in FIGS. 5A to 7B, the rear housing 5 is divided into at least two components by a first dividing surface 13 on which a central axis (a central axis of the cable 7 inserted into the cylindrical portion 11) of the cylindrical portion 11 is positioned. This is to allow the cable 7 to be fixed in the cylindrical portion 11 by bending and relatively moving the cable 7 in a radial direction of the cable 7 with respect to the cylindrical portion 11 of the rear housing 5, without relatively moving the cable 7 in the longitudinal direction with respect to the cylindrical portion 11 of the rear housing 5.

Figure 4:
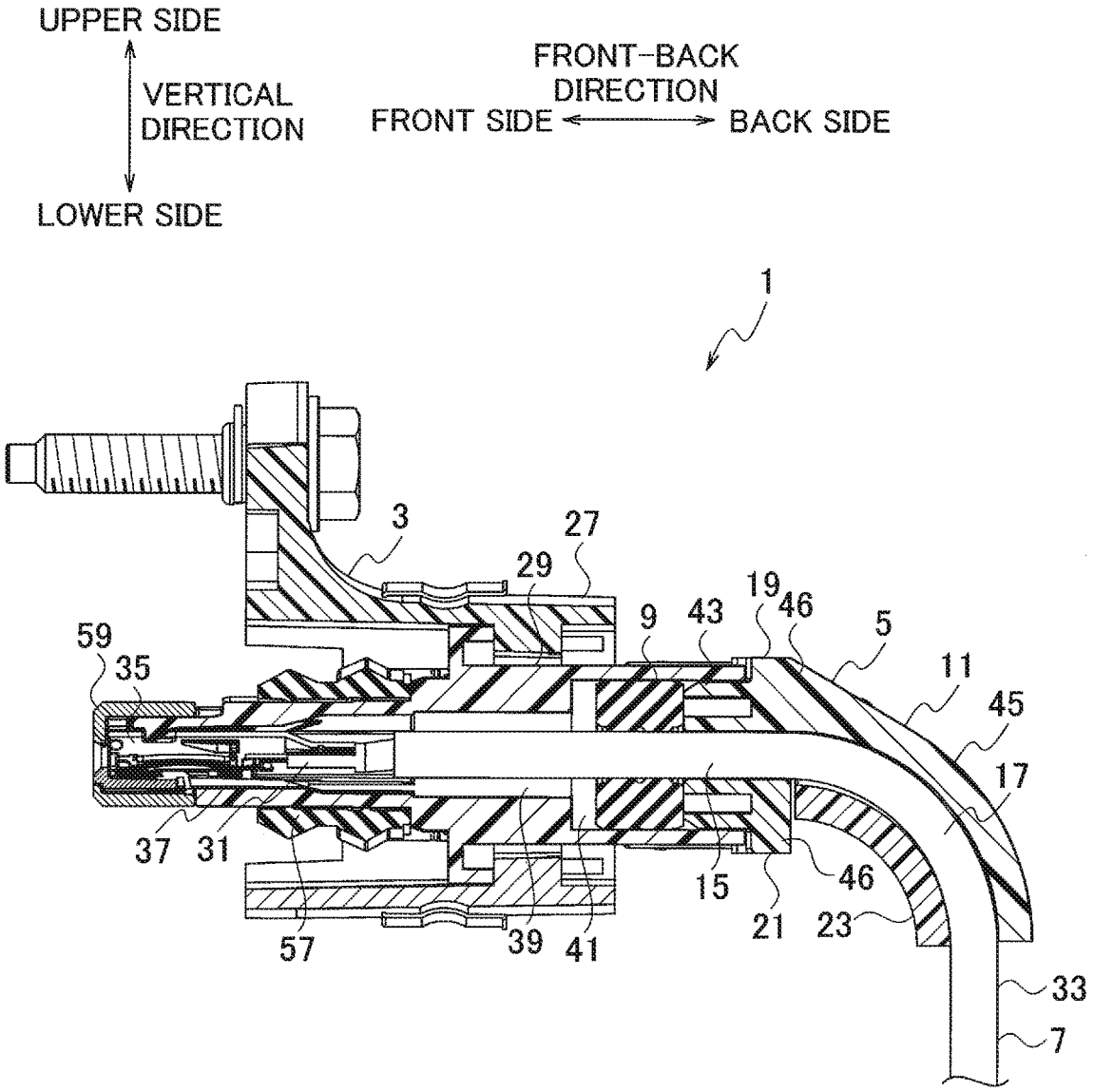
FIG. 4 is a view taken along line IV-IV in FIG. 3.

The cable 7 extending from the housing 3 (sealing material 9) linearly extends only by a predetermined short distance and then is bent in an arc shape (for example, ¼ arc; any length from 1/10 arc to ½ arc) so that the central axis of the cable 7 is positioned on one plane (for example, on the drawing of FIG. 4). It should be noted that a central axis of the linearly extending portion 15 of the cable 7 is also positioned on the one plane.

As a result, the cable 7 extending from the housing 3 (sealing material 9) linearly extends only by a predetermined small distance in the vicinity of the housing 3 (sealing material 9) and then is bent in an arc shape, such that the portions (guided portions) 15 and 17 of the cable 7 in the vicinity of the housing 3 (sealing material 9) are guided by the rear housing 5.

The central axis (coinciding with the central axis of the cable 7) of the cylindrical portion 11 is positioned on the first dividing surface 13 dividing the rear housing 5, and the first dividing surface 13 is orthogonal to the one plane on which the central axis of the cable 7 is positioned.

In addition, as described above, the cable 7 extending from the housing 3 (sealing material 9) includes the portion 15 having a short cylindrical shape and the portion 17 having a cylindrical shape of which a central axis is bent in an arc shape. The cylindrical portion 11 of the rear housing 5 guides the portion (guided portion) 15 of the cable 7 linearly extending only by the predetermined small distance, and the portion (guided portion) 17 of the cable 7 bent in the arc shape.

As illustrated in FIGS. 5A to 7B, the rear housing 5 is divided into three components 19, 21, and 23.

A first component 19 of the three divided components is one of the at least two components into which the rear housing 5 is divided by the first dividing surface 13, and is a component (a component of an upper side in FIG. 4 and the like) engaged with (in contact with) a convex surface of the cable 7 bent in the arc shape.

A second component 21 of the three divided components is one (a component of a front side in FIG. 4 and the like) of two components into which a component (a component of a lower side in FIG. 4 and the like) engaged with (in contact with) a concave surface of the cable 7 bent in the arc shape, which is the other one of the at least two components into which the rear housing 5 is divided by the first dividing surface 13, is further divided by a second dividing surface 25.

The second dividing surface 25 is positioned on a boundary between the portion 15 of the cable 7 linearly extending only by the predetermined short distance and the portion 17 of the cable 7 extending while being bent in the arc shape, and is a plane orthogonal to the central axis (front-back direction) of the cable 7.

A third component 23 of the three divided components is the other one (a component of a back side in FIG. 4 and the like) of the two components into which the rear housing 5 is divided by the second dividing surface 25.

The first and second components 19 and 21 are mounted on the housing 3 by relatively moving the first and second components 19 and 21 forward with respect to the housing 3 and inserting one end portions (front end portions) of the first and second components 19 and 21 into the housing 3 in a state in which the first component 19 and the second component 21 are combined (in surface-contact) with each other on the first dividing surface 13.

The third component 23 is mounted on the housing 3 (the first and second components 19 and 21) by moving the third component 23 upwards with respect to the housing 3, combining the first and third components 19 and 23 with each other on the first dividing surface 13, and combining the second and third components 21 and 23 with each other on the second dividing surface 25 in a state in which the first and second components 19 and 21 are integrally mounted on the housing 3.

Here, the connector 1 will be described in more detail.

The cable 7 includes a core wire 31 and an insulating sheath 33 covering the core wire 31. The insulating sheath 33 is removed and the core wire 31 is exposed at one end portion (front end portion) of the cable 7 in the longitudinal direction.

A metallic terminal (for example, a female terminal) 35 is fixed to the exposed portion of the core wire 31.

The housing 3 includes an outer housing 27 formed of an insulating material such as a synthetic resin and the like having rigidity, and an inner housing 29 formed of an insulating material such as a synthetic region and the like as well. The inner housing 29 is formed in a cylindrical shape, and is provided integrally with the outer housing 27 inside the outer housing 27.

A first space 37 in which the terminal 35 is mounted, a second space 39 having a cylindrical shape, and a third space 41 having a cylindrical shape are connected to each other and sequentially aligned from the front side toward the back side inside the cylindrical inner housing 29. A central axis of the cylindrical second space 39 and a central axis of the cylindrical third space 41 coincide with each other and extend in the front-back direction. An inner diameter of the cylindrical third space 41 is larger than an inner diameter of the cylindrical second space 39. The terminal 35 is integrally mounted in the first space 37.

The portion of the cable 7 linearly extending from the terminal 35 mounted in the first space 37 to the back side is inserted into the second space 39 and the third space 41. The central axis of the portion of the cable 7 linearly extending from the terminal 35 to the back side and the central axis of the second space 39 coincide with each other. The inner diameter of the second space 39 is larger than an outer diameter of the cable 7 (insulating sheath 33).

The sealing material 9 and a portion. (a portion of the front side) of a front end portion. (cylindrical front end portion) 43 of the rear housing 5 are inserted into the third space 41.

The sealing material 9 is formed in a cylindrical shape, an inner diameter of the sealing material 9 is slightly smaller than the outer diameter of the cable 7 (insulating sheath 33), and an outer diameter of the sealing material 9 is slightly larger than an inner diameter of the third space 41.

In a state in which the sealing material 9 is mounted in the third space 41 and the cable 7 penetrates through the sealing material 9, the sealing material 9 is appropriately elastically deformed, abuts on a wall surface of the third space 41 with an energizing force, and abuts on an outer circumference of the cable 7 with an energizing force. As a result, scalability between the inner housing 29 and the cable 7 is secured.

It should be noted that the sealing material 9 mounted in the third space 41 is positioned in the middle (middle portion) of the third space 41 or is positioned in the front side (front side portion) of the third space 41 in the front-back direction.

The rear housing 5 is formed of an insulating material such as a synthetic resin and the like having rigidity, is formed in an integrated form, and includes the front end portion 43 described above and a back end portion 45. The front end portion 43 and the back end portion 45 form the cylindrical portion 11 described above.

The front end portion 43 guides the guided portion 15 of the cable 7 extending linearly and the back end portion 45 guides the guided portion 17 of the cable 7 bent in the arc shape.

An outer diameter of the portion of the front side of the front end portion 43 is equal to or slightly smaller than the inner diameter of the third space 41, and an inner diameter of the front end portion 43 is equal to or larger than the outer diameter of the cable 7.

An outer diameter of the back end portion 45 is equal to, smaller than, or larger than the inner diameter of the third space 41. In addition, an inner diameter of the back end portion 45 is equal to or slightly larger than the outer diameter of the cable 7.

Further, the first component 19 of the cylindrical portion 11 is constituted by a portion (a semi-cylindrical portion of the upper side) of the front end portion 43 and a portion (a bent semi-cylindrical portion of the upper side) of the back end portion 45, the second component 21 of the cylindrical portion 11 is constituted by the remaining portions (a semi-cylindrical portion of the lower side) of the front end portion 43, and the third component 23 is constituted by the remaining portion (a bent semi-cylindrical portion of the lower side) of the back end portion 45.

Protruding portions 46 abutting on the inner housing 29 when the front end portion 43 of the rear housing 5 is inserted into the third space 41 to position the rear housing 5 in the front-back direction are provided on the back end portion of the first component 19 and the back end portion of the second component 21, respectively.

In the above description, a case where one cable 7 is fixed in one housing 3 has been described. However, in the present embodiment, a plurality of cables 7 (for example, two cables) are fixed in the housing 3 as illustrated in FIG. 1 and the like.

In this case, an inner housing (an inner housing in which the plurality of cables are fixed) is formed by integrating two inner housings 29 described above with each other in the transverse direction. A rear housing (a rear housing in which the plurality of cables are fixed) is formed by integrating two rear housings 5 described above with each other in the transverse direction.

Figure 5A:
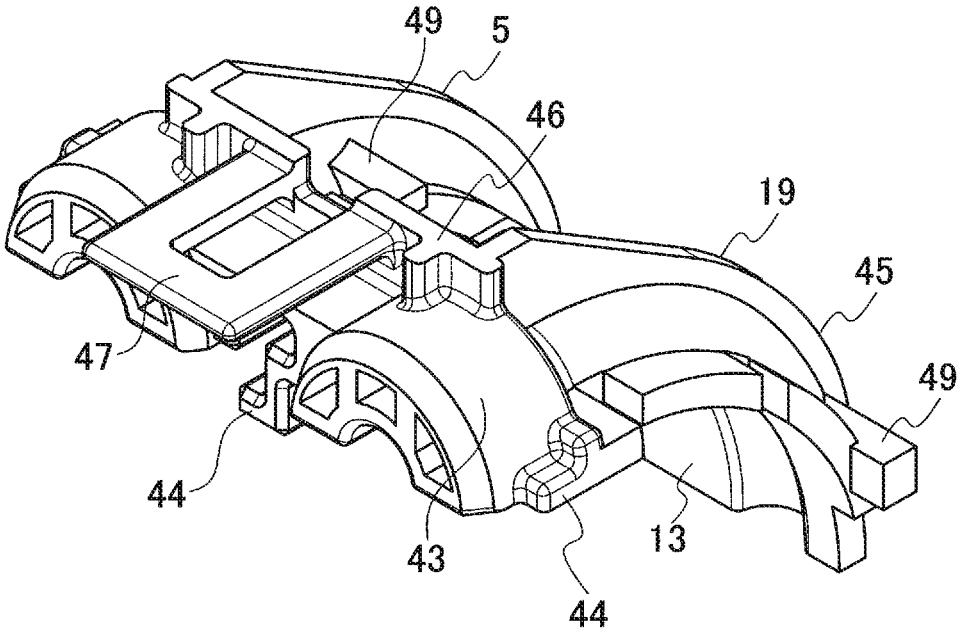
FIGS. 5A and 5B are perspective views illustrating a first component constituting a rear housing of the connector according to the embodiment of the present invention when viewed from different directions.
Figure 6:
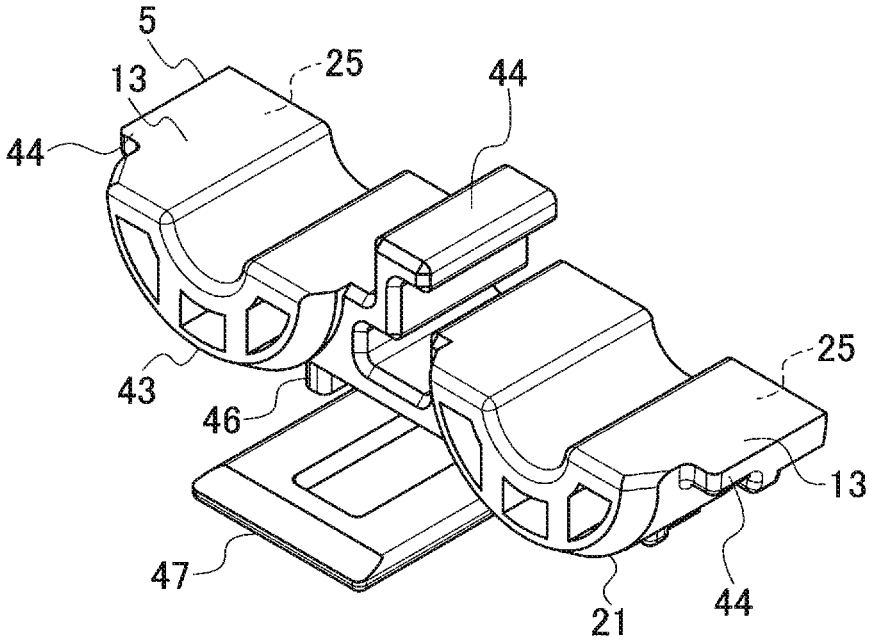
FIG. 6 is a perspective view illustrating a second component constituting the rear housing of the connector according to the embodiment of the present invention.

As illustrated in FIGS. 5A and 6, engaged portions 47 protrude from the first component 19 and the second component 21 constituting the rear housing 5 in which the plurality of cables are fixed. The engaged portions 47 protrude forward from the first component 19 and the second component 21, respectively. When completing the mounting of the first component 19 and the second component 21 in the inner housing 29 so that the portion of the front side of the front end portion 43 is inserted into the third space 41 of the inner housing 29, locking portions (not illustrated) provided on the inner housing 29 are locked to the engaged portions 47, such that the first component 19 and the second component 21 are integrated with the inner housing 29.

Further, as illustrated in FIGS. 5A to 6, small protrusions 44 formed in a flat plate shape are provided on opposite end portions and a middle portion (a portion between two guided cables 7) of the first component 19 guiding the two cables 7, in the transverse direction, respectively, and similarly, small protrusions 44 formed in a flat plate shape are provided on opposite end portions and a middle portion (a portion between the two guided cables 7) of the second component 21 guiding the two cables 7, in the transverse direction, respectively.

The protrusion 44 provided on the middle portion of the first component 19 guiding the two cables 7, in the transverse direction, and the protrusion 44 provided on the middle portion of the second component 21 guiding the two cables 7, in the transverse direction are separate from each other in the vertical direction.

In a state in which the first component 19 and the second component 21 are mounted on the inner housing 29, each of the protrusions 44 is inserted into a groove (a groove formed as a portion of an inner wall of the cylindrical third space 41 swells outwards) (not illustrated) formed in the inner housing 29 to, for example, fit the groove without rattling.

As a result, a retaining force of the housing 3 to retain the rear holder 5 (the first component 19 and the second component 21) is improved.

Even in a case where three or more cables 7 are guided, the protrusions 44 are provided, and the grooves corresponding to the protrusions 44 are also formed in the inner housing 29, similarly to the case where two cables 7 are guided.

A plurality of locking portions 49 (for example, four locking portions) are provided on the first component 19 guiding two cables 7. The plurality of locking portions 49 protrude from the first component 19. A plurality of locked portions 51 (for example, four locked portions) are provided on the third component 23 guiding the two cables 7.

When completing the mounting of the third component 23 on the first component 19 and the second component 21 in a state in which the first component 19 and the second component 21 are mounted on the inner housing 29, the plurality of locking portions 49 are locked to the plurality of locked portions 51, respectively, such that the third component 23 is integrated with the first component 19 and the second component 21 (and the housing 3).

Figure 5B:
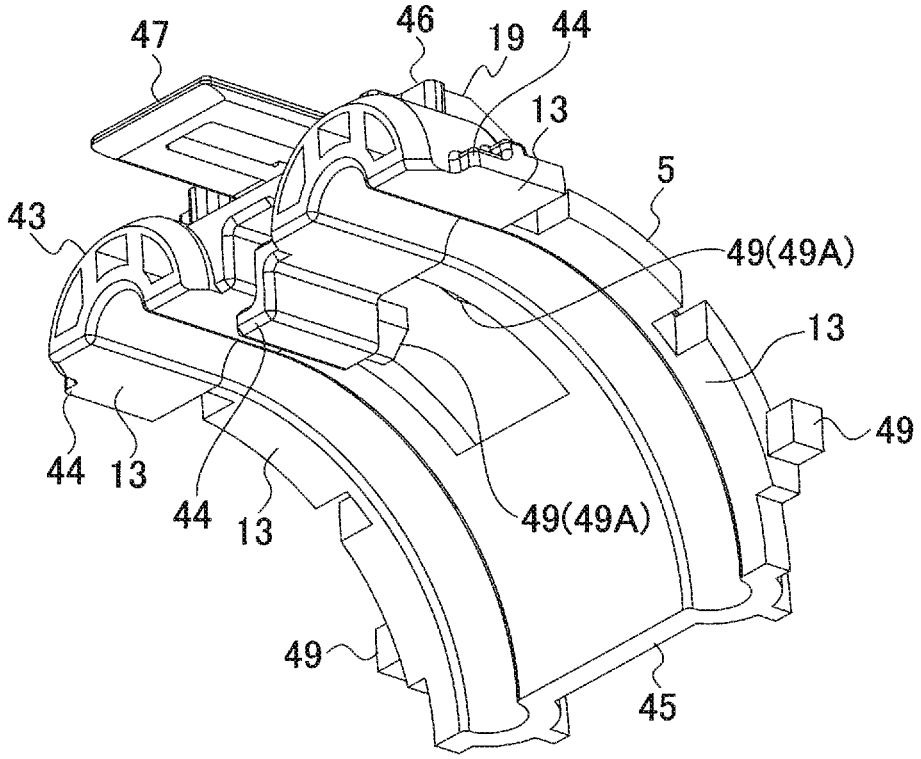

As illustrated in FIGS. 5A and 5B, two of the four locking portions 49 of the first component 19 are provided on opposite end portions of the first component 19 in the transverse direction, and the other two are provided on a middle portion of the first component 19 in the transverse direction. In addition, as illustrated in FIGS. 7A and 7B, two of the four locked portions 51 of the third component 23 are provided on opposite end portions of the third component 23 in the transverse direction, and the other two are provided on a middle portion of the third component 23 in the transverse direction.

Since the two locked portions 51 provided on the middle portion are also locked in addition to the two locked portions 51 provided on the opposite end portions in a state in which the third component 23 is mounted on the first component 19 and the second component 21 mounted on the inner housing 29, it is possible to prevent the rear holder 5 from being detached from the housing 3 (prevent the third component 23 from being detached from the first component 19) when an external force is applied due to unexpected catching or the like.

Figure 7A:
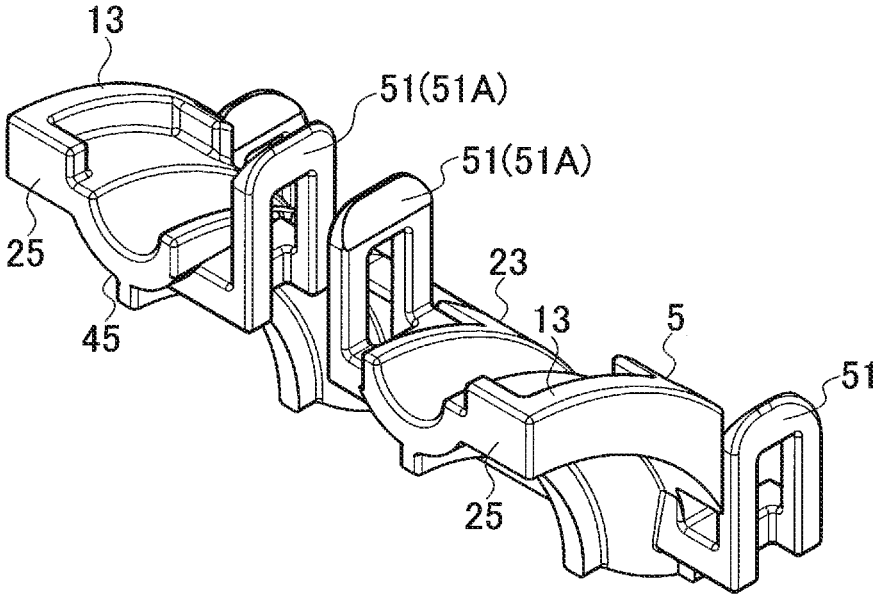
FIGS. 7A and 7B are perspective views illustrating a third component constituting a rear housing of the connector according to the embodiment of the present invention when viewed from different directions.
Figure 7B:
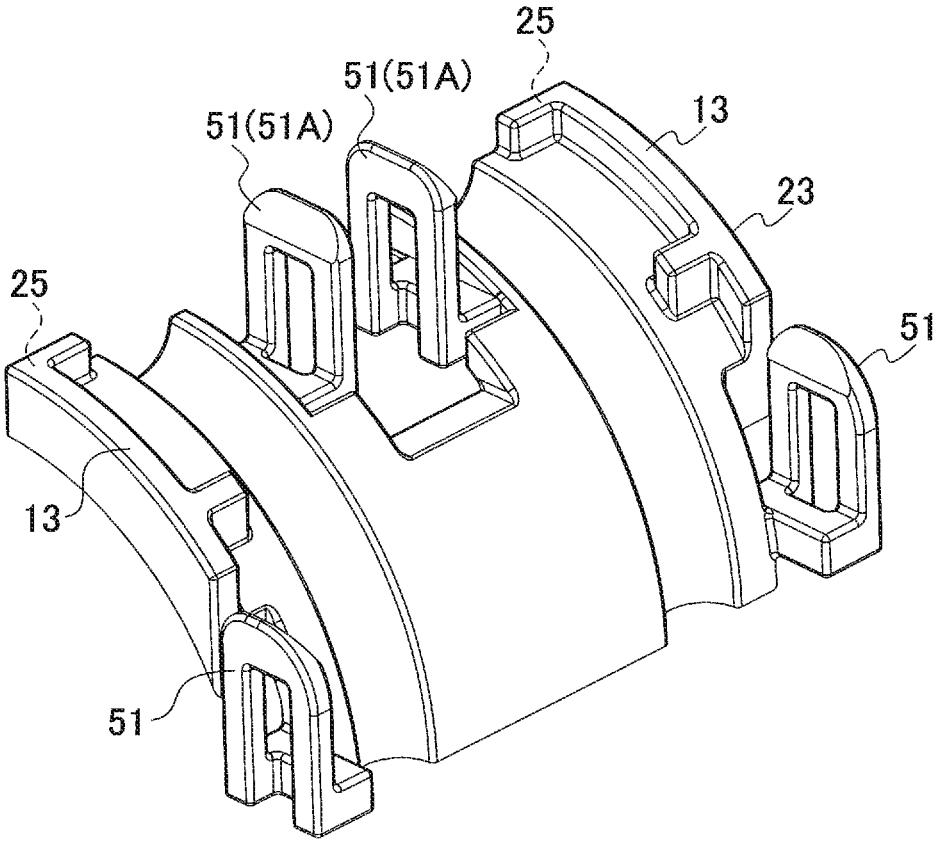
Figure 8:
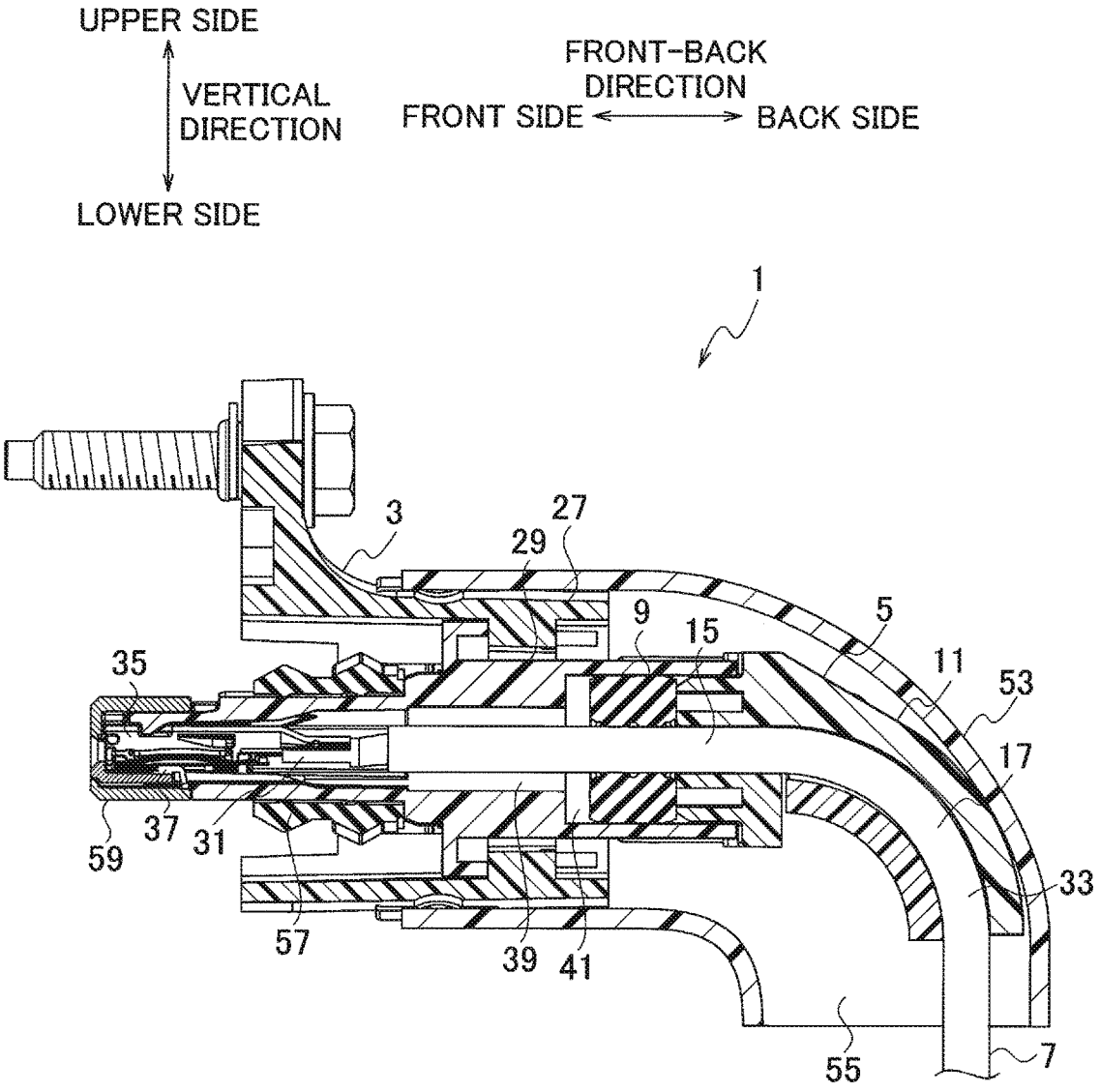
FIG. 8 is a view illustrating a state in which an exterior component is mounted on the connector illustrated in FIG. 4.
Figure 9:
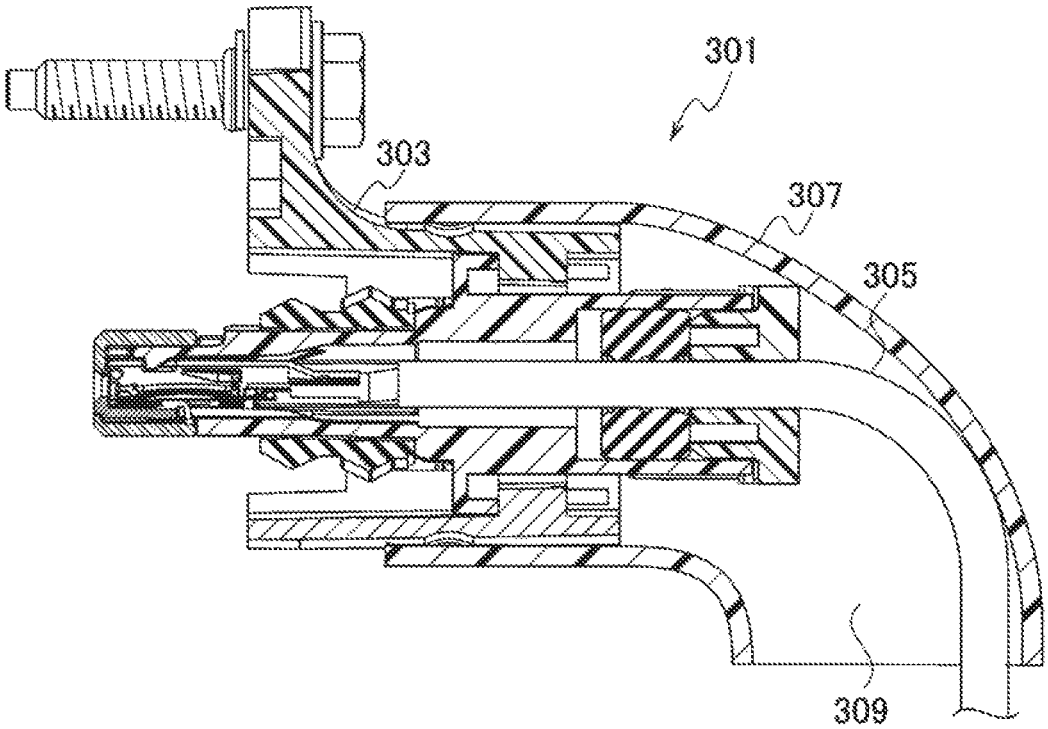
FIG. 9 PRIOR ART
FIG. 9 is a view illustrating a connector according to the related art.

One locking portion may be provided instead of the two locking portions 49 (49A) provided on the middle portion illustrated in FIG. 5B, and one locked portion may be provided instead of the two locked portions 51(51A) provided on the two middle portions illustrated in FIG. 7A.

Further, even in a case where three or more cables 7 are guided, the locking portion 49 and the locked portion 51 are provided, similarly to the case where two cables 7 are guided.

In addition, an exterior component 53 having a long cylindrical shape is mounted on a back end portion of the outer housing 27. The exterior component 53 covers the rear housing 5 and the cable 7, and a gap 55 is formed between the exterior component 53, and the rear housing 5 and the cable 7.

Next, an assembly procedure of the connector 1 will be described.

First, the inner housing 29 is mounted on the outer housing 27, and a packing 57 is mounted on the inner housing 29. The packing 57 is a component to secure sealability between a connector (not illustrated) mounted on the connector 1 and the connector 1.

Then, a cap 59 is mounted on the inner housing 29 in order to prevent the terminal 35 from being detached from the inner housing 29.

Then, the cable 7 to which the terminal (a terminal electrically conducted with the core wire 31 of the cable 7) 35 is fixed is fixed in the inner housing 29. The terminal 35 is fitted in the first space 37 and the cable 7 extends from the terminal 35 to the back side in a state in which the fixing of the cable 7 is completed.

Then, the sealing material 9 is mounted in the inner housing 29 and the rear housing 5 is mounted on the inner housing 29 to prevent the sealing material 9 from being detached and guide the cable 7, thereby maintaining the shape of the cable 7.

The rear housing 5 is mounted on the inner housing 29 in a manner in which the first component 19 and the second component 21 are mounted on the inner housing 29 first, and then the third component 23 is mounted on the first component 19 and the second component 21.

Then, the exterior component 53 is mounted on the outer housing 27 to cover the cable 7 and the rear housing 5.

In the connector 1 assembled as described above, the cable 7 is guided by the rear housing 5, and is not bent even when an external force is applied to the cable 7 in the vicinity of the inner housing 29.

In the connector 1, the rear housing 5 is configured to allow the shapes of the portions 15 and 17 of the cable 7 extending from the housing 3 to be maintained, the portions 15 and 17 being in the vicinity of the housing 3, and thus, for example, a bend radius of the bent portion 17 of the cable 7 may not become smaller than a target value but be maintained and it is possible to prevent an excessive bend stress from being applied to the cable 7.

In addition, since the shape of the cable 7 (the shapes of the portions 15 and 17 in the vicinity of the housing 3) extending from the housing 3 is maintained, a degree of freedom in a layout when mounting the connector 1 in a vehicle is increased. For example, it is possible to appropriately change the shape of the cable 7 extending from the housing 3 only by changing a shape of the rear housing 5 (cylindrical portion 11).

Further, in the connector 1, the sealing material 9 is provided, and the rear housing 5 allows the shape of the cable 7 (the shapes of the portions 15 and 17 in the vicinity of the housing 3) extending from the housing 3 to be maintained while preventing the sealing material 9 from being detached from the housing 3. Therefore, deformation of the sealing material 9 due to the deformation of the cable 7 does not occur, and it is possible to secure sealability between the housing 3 and the cable 7.

In addition, in the connector 1, the rear housing 5 is divided by the first dividing surface 13 on which the central axis of the cylindrical portion 11 is positioned, and thus the rear housing 5 can be mounted on the cable 7 bent in an arc shape and extending from the housing 3, while easily maintaining the arc shape of the cable 7.

Further, in the connector 1, the rear housing 5 is divided into three components 19, 21, and 23, and the three components 19, 21, and 23 are mounted on the housing 3 in which the cable 7 is fixed according to the procedure described above, such that the rear housing 5 is easily mounted on the housing 3.

In the above description, a case where the cable 7 is two-dimensionally bent in an arc shape (the central axis of the cable 7 is two-dimensionally bent in the arc shape) has been described by way of example. However, the cable 7 may also be three-dimensionally bent (the cable 7 may further be bent toward the front plane or the back plane of FIG. 4). In addition, the cable 7 may also be bent in a shape (for example, a curved shape) other than the arc shape.

What is claimed is:

1. A connector comprising:

a housing into which a cable is inserted;

an exterior component mounted on the housing, configured to cover the cable extending from the housing; and a rear housing having a cylindrical portion mounted on the housing and provide inside the exterior component, configured to guide the cable extending from the housing to maintain a desired bend radius of a portion of the cable, the portion being in the vicinity of the housing, the guiding of the cable by the rear housing is made as the cable is inserted into the cylindrical portion of the rear housing, the rear housing is divided into at least two components by a first dividing surface on which a central axis of the cylindrical portion is positioned, the cable extending from the housing linearly extends only by a predetermined short distance and then is bent in an arc shape so that a central axis of the cable is positioned in one plane, the cylindrical portion of the rear housing guides the portion of the cable linearly extending by the predetermined small distance and the portion of the cable bent in the arc shape, the rear housing is divided into a first component, a second component, and a third component, the first component is one of the at least two components into which the rear housing is divided by the first dividing surface and is a component engaged with a convex surface of the cable bent in the arc shape, the second component is one of two components into which a component engaged with a concave surface of the cable bent in the arc shape is further divided by a second dividing surface, the component engaged with the concave surface of the cable bent in the arc shape being the other one of the at least two components into which the rear housing is divided by the first dividing surface, the second dividing surface is positioned on a boundary between the portion of the cable linearly extending only by the predetermined short distance and the portion of the cable extending while being bent in the arc shape and is a plane orthogonal to the central axis of the cable, and the third component is the other one of the two components into which the component engaged with the concave surface of the cable bent in the arc shape is divided by the second dividing surface.

2. A connector comprising: a housing into which a cable is inserted; an exterior component mounted on the housing, configured to cover the cable extending from the housing; a rear housing having a cylindrical portion mounted on the housing and provided inside the exterior component, configured to guide the cable extending from the housing to maintain a desired bend radius of a portion of the cable, the portion being in the vicinity of the housing; and a sealing material into which the cable is inserted and which is mounted in the housing to seal between the housing and the cable, wherein one end portion of the rear housing is inserted into the housing to prevent the sealing material from being detached from the housing, the guiding of the cable by the rear housing is made as the cable is inserted into the cylindrical portion of the rear housing, the rear housing is divided into at least two components by a first dividing surface on which a central axis of the cylindrical portion is positioned, the cable extending from the housing linearly extends only by a predetermined short distance and then is bent in an arc shape so that a central axis of the cable is positioned in one plane, the cylindrical portion of the rear housing guides the portion of the cable linearly extending by the predetermined small distance and the portion of the cable bent in the arc shape, the rear housing is divided into a first component, a second component, and a third component, the first component is one of the at least two components into which the rear housing is divided by the first dividing surface and is a component engaged with a convex surface of the cable bent in the arc shape, the second component is one of two components into which a component engaged with a concave surface of the cable bent in the arc shape is further divided by a second dividing surface, the component engaged with the concave surface of the cable bent in the arc shape being the other one of the at least two components into which the rear housing is divided by the first dividing surface, the second dividing surface is positioned on a boundary between the portion of the cable linearly extending only by the predetermined short distance and the portion of the cable extending while being bent in the arc shape and is a plane orthogonal to the central axis of the cable, and the third component is the other one of the two components into which the component engaged with the concave surface of the cable bent in the arc shape is divided by the second dividing surface.

* * * * *